US006679233B1

(12) United States Patent
Melbourne

(10) Patent No.: US 6,679,233 B1
(45) Date of Patent: Jan. 20, 2004

(54) START-UP METHOD FOR AN INTERNAL COMBUSTION ENGINE

(75) Inventor: Keith Melbourne, Mount Hawthorn (AU)

(73) Assignee: Orbital Engine Company (Australia) Pty Limited, Balcatta (AU)

( * ) Notice: Subject to any disclaimer, the term of this patent is extended or adjusted under 35 U.S.C. 154(b) by 0 days.

(21) Appl. No.: 09/509,822

(22) PCT Filed: Oct. 20, 1998

(86) PCT No.: PCT/AU98/00873

§ 371 (c)(1),
(2), (4) Date: Jul. 21, 2000

(87) PCT Pub. No.: WO99/20895

PCT Pub. Date: Apr. 29, 1999

(30) Foreign Application Priority Data

Oct. 20, 1997 (AU) ..... PO 9885

(51) Int. Cl.[7] ..... F02M 67/04
(52) U.S. Cl. ..... 123/533; 123/534
(58) Field of Search ..... 123/533, 534

(56) References Cited

U.S. PATENT DOCUMENTS 4,936,279 A * 6/1990 Ragg ..... 123/533
5,025,769 A * 6/1991 Plohberger et al. ..... 123/532

FOREIGN PATENT DOCUMENTS

JP 4-19359 * 1/1992 ..... F02M/67/04
JP 4-72461 * 3/1992 ..... F02M/67/02

OTHER PUBLICATIONS

Abstract of Japanese Patent Publ. No. 4–72461; dated Mar. 6, 1992.

Abstract of Japanese Patent Publ. No. 4–19359; dated Jan. 23, 1992.

Abstract of Japanese Patent Publ. No. 4–86374; dated Mar. 18, 1992.

* cited by examiner

*Primary Examiner*—Andrew M. Dolinar
(74) *Attorney, Agent, or Firm*—Rothwell, Figg, Ernst & Manbeck

(57) ABSTRACT

An internal combustion engine and a method of operating said engine, the engine having a plurality of cylinders (3,4,5) each respectively supporting a piston (6) therein, a fuel injection system (2) including a plurality of selectively operable delivery injector nozzles (10), and a gas supply system (7) for supplying gas to the delivery injector nozzles (10), each delivery injector nozzle (10) arranged to respectively deliver fuel by way of said gas directly into a said engine cylinder (3,4,5), the method including opening the delivery injector nozzles (10) of a first said cylinder and a second said cylinder such that gas within the first said cylinder is transferred through the delivery injector nozzle (10) thereof and into the gas supply system (7) resulting in gas being supplied to the delivery injector nozzle (10) of the second said cylinder to thereby effect the delivery of fuel by way of the gas to the second said cylinder.

51 Claims, 3 Drawing Sheets

START-UP METHOD FOR AN INTERNAL COMBUSTION ENGINE

This invention relates to fuel injected internal combustion engines where delivery or air injectors respectively deliver metered quantities of fuel directly into the or each cylinder of the engine by means of compressed gas. In engines comprising such two fluid injection systems, the metered quantities of fuel are delivered into the or each combustion chamber of the engine entrained in the gas, typically air, which is supplied from a pressurized gas source, typically a gas duct or rail.

In most engines, a delay is normally experienced between the initial rotation of the engine and the subsequent firing of the engine. Due to commercial and user considerations, this delay or start-up period is typically desired to be as short as possible under a wide range of conditions. For example, an engine may be employed for operation under ambient and extreme ambient conditions. Efficient engine operation is important no matter the conditions.

In engines having a fuel injection system of the type above described, an important part of achieving a rapid start-up period is the ready availability of compressed gas at an adequate pressure to assure effective fuel delivery as close to start of cranking as possible. However, for cost and other considerations, it is not convenient to provide a relatively large compressed air storage capacity or generation means and, in any event, there is also the risk of loss of pressure due to leakage, particularly when the engine has been inoperative for a period.

Typically, a compressor driven by the engine is provided as the means for supplying compressed gas to a two-fluid fuel injection system as above described. For both reasons of economy and energy efficiency, it is customary to select the compressor capacity to closely match the air consumption rate of the engine during running conditions. Thus, the compressor would typically require a certain period of time to increase the air pressure to a suitable level as required during start-up. That is, the compressor, and thus the engine, must complete a number of cycles before air is available for satisfactory injection of fuel at the required pressure.

The above factors contribute to the lengthening of the period between commencement of the start-up sequence of the engine and the availability of air at the required pressure for injection of fuel. In this regard, the Applicant has developed several methods for minimizing the start-up period in certain engines.

In the Applicant's U.S. Pat. No. 4,936,279, there is described a method of operating an engine during an engine start-up period. The engine includes a gas supply system for supplying gas to the delivery or air injectors. The gas supply system normally includes a gas supply volume, commonly known as an "air rail", from which pressurized gas is supplied to each of the delivery injectors. Compressed gas for the air rail is normally supplied by a compressor driven by the engine. As alluded to hereinbefore, the compressor must however complete a number of cycles after engine start-up before the compressor can provide sufficient compressed gas to pressurize the air rail to within a working pressure range. The gas within the air rail and as supplied to the delivery injectors needs to be at a high enough pressure to enable the delivery injectors to inject a metered quantity of fuel into cylinders supporting a piston typically undergoing a compression stroke and therefore containing gas under a relatively high pressure. The pressure of the gas must also be sufficient to enable satisfactory atomisation and entrainment of the fuel being injected. The method described in this patent involves effecting one or more "pump-up" events by delivering pressurized gas from respective cylinders of the engine into the gas supply system during the engine start-up period by opening the delivery injector nozzle for each cylinder undergoing a compression stroke of the piston located therein. This results in a progressive increase in the pressure within the gas supply system until the pressure is within the required working pressure range at which time the delivery injectors can begin delivering fuel.

It is further known from the Applicant's subsequent PCT Patent Application No. PCT/AU97/00438 filed on Jul. 10, 1997 that the delivery injector nozzle 10 may be opened and closed at successively closer timings to the top dead centre (TDC) position of a piston reciprocating in a cylinder of the engine over a sequence of pump-up events to shorten the start-up period of the engine. This patent application also discusses holding the delivery injector nozzle open for a certain period after the engine has commenced firing to continue pressurising the gas supply system prior to the main source of compressed gas being able to adequately pressurize the gas supply system.

It has however been found that the period required to pressurize the air rail to within the working pressure range during start-up of the engine can still be too long for certain engine applications. For example, in cord or pull start engines as typically used in snowmobiles, small outboard engines and lawn-mowers, the start-up period needs to be relatively short, such that start-up can be achieved within the period prior to full extension of the cord. Because the above methods require a sufficient period of time for the engine to determine its angular position and to subsequently pressurize the air rail by suitable means, these methods may therefore not be applicable for certain cord or pull start engines. More generally, the ever increasing requirement for shorter start-up periods may result in these methods not being able to provide for start-up periods below a certain point.

It is therefore an object of the present invention to provide a method of fuel delivery for a two-fluid fuel injection system wherein the gas provided to enable delivery of a metered quantity of fuel into a cylinder of the engine is derived directly from a different cylinder of the engine.

It is a further preferred object of the present invention to provide a method for enabling the reduction of the duration of the start-up period for an engine incorporating a two-fluid fuel injection system.

With this in mind, the present invention provides in one aspect a method of operating an internal combustion engine, the engine having a plurality of cylinders each respectively supporting a piston therein, a fuel injection system including a plurality of selectively operable delivery injector nozzles, and a gas supply system for supplying gas to the delivery injector nozzles, each delivery injector nozzle arranged to respectively deliver fuel by way of said gas directly into a said engine cylinder, the method including opening the delivery injector nozzles of a first said cylinder and a second said cylinder such that gas within the first said cylinder is transferred through the delivery injector nozzle thereof and into the gas supply system resulting in gas being supplied to the delivery injector nozzle of the second said cylinder to thereby effect the delivery of fuel by way of the gas to the second said cylinder, wherein each second said cylinder into which fuel is delivered is operated to effect combustion of said delivered fuel for each cylinder cycle.

The method according to the present invention may be used during start-up of the engine to facilitate the reduction of the start-up time for the engine. It is however also possible for this method to be used when the engine is operating under alternative conditions. For example, the method could be used to operate the engine under a "limp-home" mode if an air compressor supplying compressed gas to the fuel injection system fails resulting in a loss of pressure within an air rail of the fuel injection system.

The method may be implemented so as to not effect the normal start-up firing sequence of the cylinders, and each delivery injector nozzle and associated cylinder may be operated to effect combustion of a said delivered fuel in the normal manner. That is, the method may be implemented such that each cylinder remains operational to effect combustion in the normal manner. Hence, there is no requirement to cease fuelling to any engine cylinders (ie: to shut them down) or to ship the fuelling event on any cylinder whilst the method of the present invention is being used.

Preferably, the timing of opening and the open period of the delivery injector nozzle of the first said cylinder may be selected so as to provide for a maximum possible pressure to be captured or transferred into the gas supply system from the first said cylinder. This gas pressure may then be used to effect delivery of fuel by way of the gas to the second said cylinder. Typically, some of this gas pressure may remain in the gas supply system after the fuel has been delivered to the second said cylinder such that he pressure in the gas supply system may eventually be increased to a pre-determined level. As cylinder pressure is directly related to crank angle, the opening and closing events for the delivery injector nozzle of the first said cylinder may preferably be controlled with respect to crank angle. Typical timings for any engine configuration for the opening and closing events for the delivery injector nozzle of the first said cylinder are between 90° BTDC and 10° ATDC. Preferably, the timing of opening of the delivery injector nozzle of the second said cylinder is selected so as to provide for a maximum possible differential pressure between the pressure within the gas supply system and the pressure within the second said cylinder. This ensures that the fuel may be satisfactorily delivered into the second said cylinder by way of gas.

Preferably, the delivery injector nozzle of the first said cylinder is conveniently opened when the gas pressure therein has commenced or is increasing in magnitude. Preferably, the delivery injector nozzle of the first said cylinder is opened while said piston supported therein has initiated or is undergoing a compression stroke.

Preferably, the delivery injector nozzle of the second said cylinder is opened at a point where the gas pressure in said cylinder is lower than the gas pressure in the gas supply system. Conveniently, the delivery injector nozzle of the second said cylinder is opened shortly before or once said piston supported therein has reached the bottom dead centre (BDC) position of its travel. That is, the delivery injector nozzle of the second said cylinder is conveniently opened when the gas pressure therein is at or near its lowest point. In this way, it is ensured that some or all of the gas that has been transferred into the gas supply system from the first said cylinder will subsequently be transferred from the gas supply system into the second said cylinder when the delivery injector nozzle therefore is opened at the same time. Hence, injection may typically occur early in the cylinder cycle of the second said cylinder such that it does not take place against a rising cylinder pressure.

Conveniently, the nozzle of the second said cylinder is opened when said piston supported therein is about to or has just completed an expansion or power stroke. With particular regard to a four-stroke cycle engine, the injector nozzle of the second said cylinder may also or alternatively be opened when said piston supported therein is about to or has just completed an intake or induction stroke. As far as normal engine running, the opening duration of the delivery injector nozzle of the second said cylinder is only a time related dependency. However, the start of the fuel delivery event into the second said cylinder may preferably be phased to crank angle so as to provide for a maximum differential gas pressure across the delivery injector nozzle of the second said cylinder. In this regard, in order to achieve such a maximum differential pressure, the timing of opening of the delivery injector nozzle of the second said cylinder is selected such that the associated gas capture/transfer event on the first said cylinder has been at least substantially or fully completed (ie: ensuring the maximum possible gas pressure has been transferred into the gas supply system). However, the timing of opening of the delivery injector nozzle of the second said cylinder cycle such that the pressure within the second said cylinder has not substantially increased.

Accordingly, the fuel delivery event for the second said cylinder is preferably a duration controlled event that commenced at a defined crank angle. Typical timings of the start angle for the fuel delivery event on a 3 cylinder 2-stroke engine may be between 110–120° BTDC whilst on a 4 cylinder 4-stroke engine may be between 170–180° BTDC. A typical duration for the opening period of the delivery injector nozzle of the second said cylinder for either engine configuration may be 6 ms.

As noted above, the method of operating an internal combustion engine according to the present invention may be effected during a start-up period of the engine. That is, the method may be effected until the main source of compressed gas is able to adequately pressurize the gas supply system for satisfactory fuel delivery to the engine. Alternatively, the method of the present invention may be effected in combination with one or more of the Applicants' prior known methods during the start-up period or even after that period.

For example, as alluded to hereinbefore, the opening time and/or period of the injector nozzle of the first said cylinder may be such as to enable gas transfer to effect fuel delivery into the second said cylinder (ie: without the need to bring the pressure in the gas supply system up to a predetermined level over a number of cylinder cycles) as well as to provide some pressurisation of the gas supply system or volume (ie: to a higher level). The opening and closing times of the injector nozzle of the first said cylinder over successive openings thereof may also be arranged to progressively increase the gas pressure in the gas supply system as well as to continue to effect gas transfer to enable fuel delivery into the second said cylinder. That is, for an optimized rate of rise of the pressure in the gas supply system, the crank angle timing for successive gas capture/transfer events may be sequenced such that crank angle opening and closing timings get closer to the TDC position of the first said cylinder as the pressure within the gas supply system rises. This will avoid any back flow of pressure from the gas supply system into the first said cylinder.

Further, pump-up events may continue to occur even after combustion is taking place in a cylinder in the manner as discussed in the Applicant's PCT Patent Application No. PCT/AU97/00438, the contents of which are included herein by reference.

Conveniently, the gas supply system supplies gas to the delivery injector to effect the delivery of an air/fuel mixture to the engine.

In the case of engines having more than two cylinders, the method may be conducted sequentially over respective pairs of cylinders. It should however be noted that this method does not necessarily limit the method such that successive cylinder pairs must be used in the method. It is possible that one cylinder pair may be bypassed in the sequential event such that there is no gas transfer between that cylinder pair.

Preferably, the opening of the delivery injector nozzles of the first said cylinder and the second said cylinder may be overlapped over a predetermined period. In this way, gas which is transferred into the gas supply system from the first said cylinder effectively results in gas being immediately supplied to the second said cylinder through the delivery injector nozzle thereof to thereby effect the delivery of fuel thereto.

In such a scenario, the delivery injector nozzle of the second said cylinder may conveniently be opened at a point where the gas pressure in said cylinder is lower than the gas pressure in the first said cylinder. It has been found that by overlapping the opening of the injector nozzles of the two noted cylinders, that the volume and pressure of the transferred or displaced gas is sufficient to enable the satisfactory delivery of fuel from the injector nozzle of the second cylinder.

It is to be noted that a metered quantity of fuel will typically be wholly or partly delivered to the delivery injector nozzle of the second said cylinder prior to the transferred gas passing therethrough. Further, in certain circumstances, the metered quantity of fuel will be delivered to the delivery injector nozzle once the transferred or displaced gas has commenced being delivered thereby.

Unlike previous systems, there is no requirement to pressurize the gas supply system over a number of cylinder cycles to a predetermined level before fuel delivery is effected. Accordingly, this results in a significantly shorter start-up period for the engine.

Preferably, the period of opening of the two injector nozzles may be at least substantially identical.. For example, in regard to a three cylinder two-stroke engine, the injector nozzle of the first cylinder may be opened about the TDC point, for example between 90 degrees before TDC to 10 degrees after TDC, while the injector nozzle of the second cylinder may be opened about the BDC point, for example between 210 degrees before TDC to 110 degrees before TDC. The opening and closing times for the injector nozzles may be scheduled in the crank angle domain, time domain, or both, in accordance with known practice.

It is preferable that the delivery of the metered quantity of fuel, particularly during the start-up period, occurs before any significant pressure rise in the second said cylinder and so the inlet and/or exhaust ports of the second cylinder may be open at least during the initial portion of the period of opening of the injector nozzle thereof. That is, the inlet and/or exhaust ports of the second cylinder may be open for the duration or at least part of the fuel injection event within the second cylinder. This ensures that the pressure within the second cylinder remains relatively low during the gas transfer/displacement event to thereby facilitate the injection of the air and fuel mixture into the cylinder.

The gas supply system may include a gas supply volume, typically an air rail, a compressor for supplying compressed gas to the gas supply volume and a communication means between the gas supply volume and the compressor. The gas supply volume may include an isolating means, for example a one-way valve, as is described in the Applicant's PCT Patent Application No. PCT/AU97/00438, the contents of which are incorporated herein by reference. In this way, the gas supply volume may be isolated from the compressor and preferably also the communication means, at least during the start-up period of the engine. This ensures that gas delivered from a first said injector nozzle is transferred into the gas supply volume and that gas is subsequently delivered therefrom to the next injector nozzle without any of the gas within the gas supply volume entering the volume provided by the communication means and by the compressor. That is, the overall volume of the gas supply system during start-up is reduced which hence increases the gas flow rate from the gas supply system to the injector nozzle of the second cylinder.

According to another aspect of the present invention, there is provided an internal combustion engine having a plurality of cylinders each respectively supporting a piston therein, a fuel injection system including a plurality of selectively operable delivery injector nozzles, and a gas supply system for supplying gas to the delivery injector nozzles, each delivery injector nozzle arranged to respectively deliver fuel by way of said gas directly into a said engine cylinder, said engine including control means for controlling the engine so as to open the delivery injector nozzles of a first said cylinder and of a second said cylinder such that gas within the first said cylinder is transferred through the delivery injector nozzle thereof and into the gas supply system resulting in gas being supplied to the delivery injector nozzle of the second said cylinder to thereby effect the delivery of fuel by way of the gas to the second said cylinder, wherein each second said cylinder into which fuel is delivered is operated to effect combustion of said delivered fuel for each cylinder cycle.

Preferably the control means for controlling the engine does so by selecting the timing of opening and the open period of the first said cylinder so as to provide for a maximum possible pressure to captured or transferred into the gas supply system from the first said cylinder. Conveniently, some of this pressure will be retained in the gas supply system after the fuel has been delivered to the second said cylinder such that the pressure in the gas supply system may eventually be increased to a pre-determined level.

Preferably, the control means controls the timing of opening and the open period of the delivery injector nozzle of the second said cylinder so as to provide for a maximum possible differential pressure between the pressure within the gas supply system and the pressure within the second said cylinder.

Preferably, the control means controls the delivery injector nozzle of the first said cylinder such that it opens whilst said piston supported therein has initiated or is undergoing a compression stroke. Preferably, the control means controls the delivery injector nozzle of the second said cylinder such that it opens at a point where the gas pressure in said cylinder is lower than the gas pressure in the gas supply system. In particular, the control means may open the delivery injector nozzle of the first cylinder about the TDC point, while the control means may open the delivery injector nozzle of the second cylinder about the BDC point. Preferably, the control means for controlling the engine does so by overlapping the opening of the delivery injector nozzle of the first said cylinder and the opening of the delivery injector nozzle of the second said cylinder.

Preferably, the control means controls the engine during a start-up period thereof.

The gas supply system may include a gas supply volume, typically an air rail, a compressor for supplying compressed gas to the gas supply volume and a communication means between the gas supply volume and the compressor.

An isolating means may be provided between the gas supply volume and the compressor for isolating the compressor and preferably also the communication means from the gas supply volume, at least during the start-up period of the engine. The provision of such an isolating means hence allows for rapid pressurisation of the gas supply volume thereby reducing the start-up period of the engine when one of the earlier noted start-up methods is used. The isolating means may include a one-way valve means located between the gas supply volume and the compressor. The communication means between the gas supply volume and the compressor may include a supply conduit and the valve means may alternatively be located between the supply conduit and the gas supply volume. It is also envisaged that the valve means may be located anywhere along the supply conduit.

The invention will be more readily understood from the following description of one preferred embodiment of a two fluid fuel injection system for an internal combustion engine as illustrated in the drawings.

The present invention will be described with respect to a three cylinder two stroke engine. It is however to be appreciated that the present invention is equally applicable to both two stroke and four stroke engines having two or more cylinders.

Figure 1:
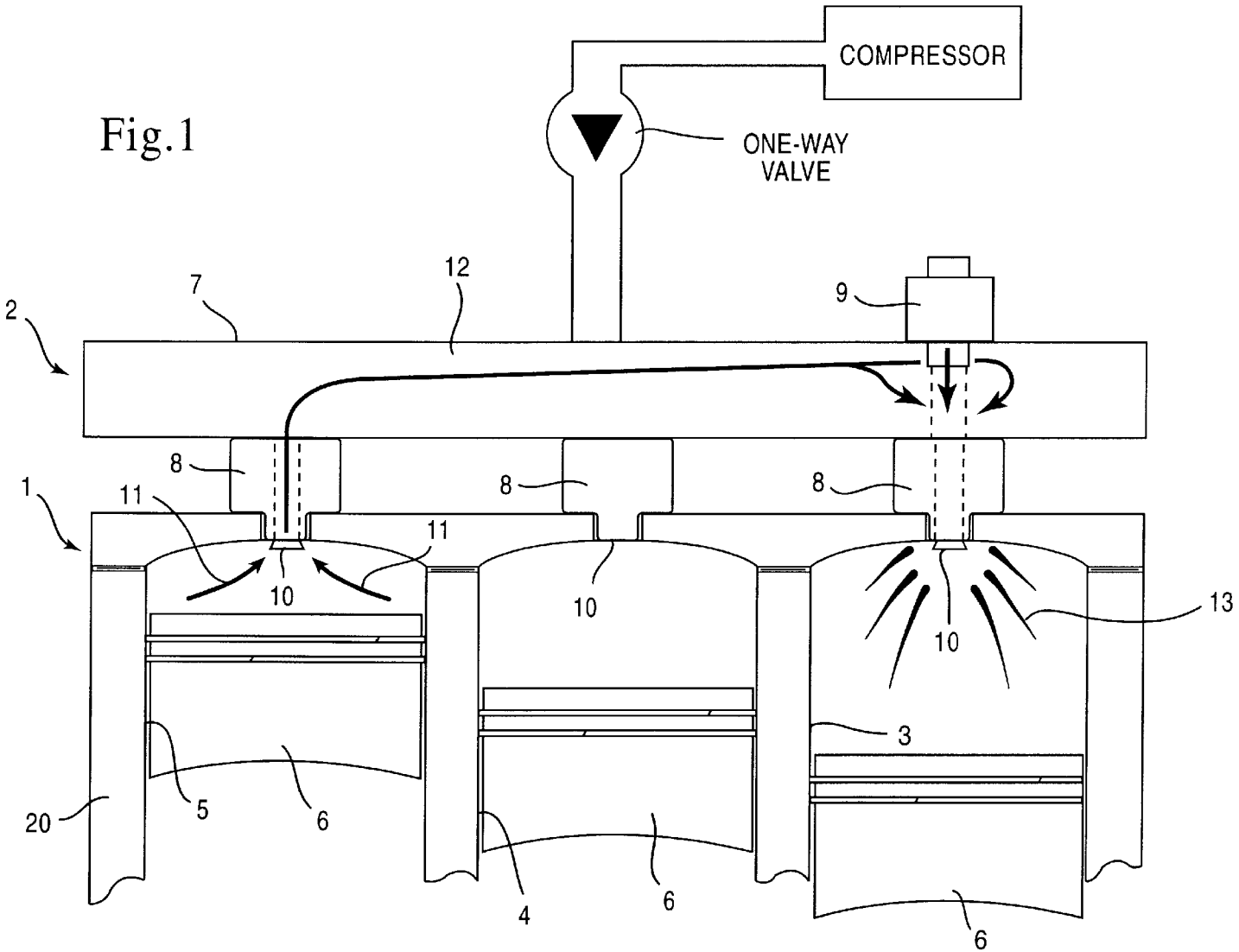
FIG. 1 is a schematic view of a two fluid fuel injection system mounted on the cylinder head of an internal combustion engine illustrating the method according to the present invention.

Referring initially to FIG. 1, there is shown a cylinder head 1 of a two stroke engine upon which is supported a two fluid fuel injection system 2. The cylinder head 1 is shown in association with three cylinders 3, 4, 5 provided within an engine block 20. Each cylinder supports a piston 6 therein.

The two fluid fuel injection system 2 includes an air rail 7, and an air injector 8 for each cylinder 3, 4, 5. Each air injector 8 is operatively arranged in conjunction with a corresponding fuel injector 9, only one of which is shown in FIG. 1 for clarity reasons. The air rail 7 supplies compressed air to each of the air injectors 8 during normal operation of the engine, the air rail 7 typically being pressurized at around 650 kPa such that the fuel delivered by the fuel injector 9 to the associated air injector 8 can be effectively entrained and atomised when delivered to the associated cylinder 3, 4, 5. The air rail 7 is typically arranged to receive compressed air from an air compressor.

It is to be noted that whilst the present embodiment relates to a dual fluid injection system where a separate fuel injector 9 is provided in association with each deliver injector 8, the present invention is equally applicable to other dual fluid fuel injection systems wherein, for example, the fuel to be delivered by the compressed gas is metered by one or more positive displacement means or some other passive fuel metering means. Further, the present invention is equally applicable to dual fluid injection systems which rely on means other than a compressor to provide the compressed gas for fuel delivery during normal operation. For example, the present invention is equally applicable to systems which rely on cylinder pressure entrapment such as that described in the Applicant's U.S. Pat. No. 5,622,155, the contents of which are incorporated herein by reference.

The time involved in bringing the air rail 7 up to the desired normal operational pressure can be quite significant, for example, at least one second. This may restrict the use of such dual fluid fuel injection systems in certain applications such as in cord or pull start engines where there is very little time to fire up the engine. The method according to the present invention therefore seeks to provide a significant reduction of the start-up time.

Figure 2:
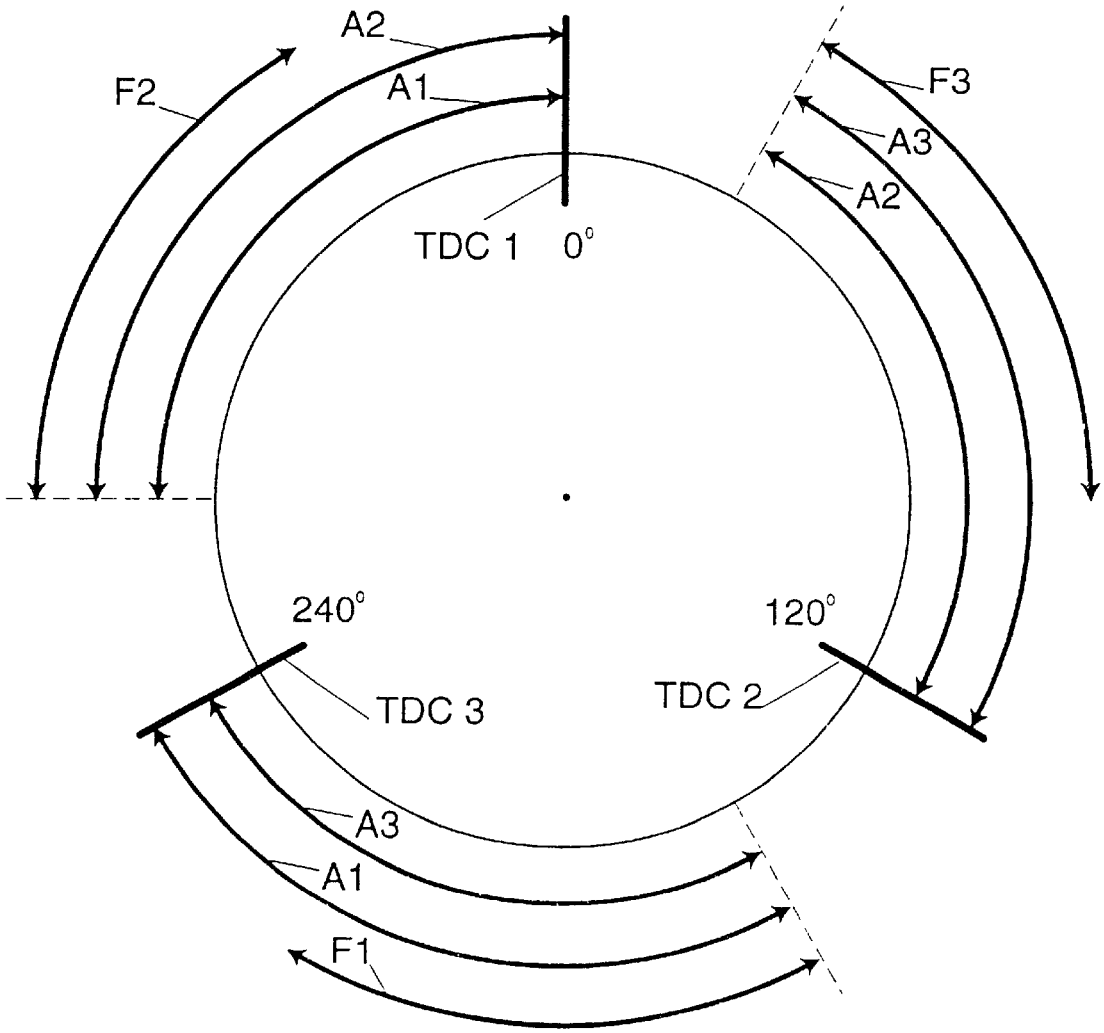
FIG. 2 is an injector timing chart for a three cylinder, two stroke engine operating according to the method of the present invention.

According to the present invention, during engine start-up, the delivery injector nozzle 10 of the air injector 8 of a first cylinder 5 may be opened during a compression stroke of the piston 6 of the cylinder 5 as the piston 6 approaches it's TDC position. Furthermore, the delivery injector nozzle 10 of the air injector 8 of a second cylinder 3 may be opened during an expansion or intake stroke of the piston 6 of that cylinder 3 as the piston 6 is near or immediately after it's BDC position. An overlap of the opening of the delivery injector nozzle 10 of the first or "delivery" cylinder 5 and the second or "receiving" cylinder 3 is provided such that there is a gas transfer or displacement from the delivery cylinder 5 through its delivery injector nozzle 10 into the air rail 7 and from the air rail 7 into the receiving cylinder 3 through its delivery injector nozzle 10. This gas transfer/displacement process enables the delivery of an air/fuel charge to the receiving cylinder 3. That is, gas flow into the air rail 7 effectively increases the gas pressure therein whereupon some gas exits the air rail 7 into the receiving cylinder 3. FIG. 1 shows schematically the gas transfer process with the gas 11 from the delivery cylinder 5 flowing through the injector nozzle 10 thereof, and resulting in gas flow through the air rail 7 in the general direction as shown by the flow line 12 leading from the delivery injector nozzle 10 of the delivery cylinder 5 to the delivery injector nozzle 10 of the receiving cylinder 3. This gas transfer/displacement process then effects the delivery of a metered quantity of fuel 13 into the receiving cylinder 3. The gas is therefore effectively transferred directly between the cylinders and there is effectively little to no "pump-up" of the air rail 7. Following this effective gas transfer, the method can be conducted sequentially over other respective pairs of cylinders of the engine as shown in FIG. 2. It has been found that this arrangement can provide 70 to 90 kPa of pressure to the delivery injector nozzle 10 of the receiving cylinder 5. It is however to be noted that, as alluded to hereinbefore, the method of the present invention may be implemented such that some pressurisation of the air rail 7 does take place whilst gas from one cylinder is being used to affect fuel delivery into a second cylinder. In this way, the pressure within the air rail 7 may be progressively increased to a predetermined level whilst fuel is being delivered to the engine cylinders by way of the gas transfer/displacement method as described according to the present invention.

During normal operation of the engine, an air compressor provides compressed air to the air rail 7. A one-way valve can be provided between the compressor and the air rail 7 to isolate the compressor from the air rail 7 during the start-up sequence described above. The one-way valve will however remain permanently open when the compressor begins delivering compressed air at the normal operating pressure.

FIG. 2 shows the injector timing chart for a three cylinder two stroke engine when the method of the present invention is employed. This chart shows the typical injector timings during the start-up of such an engine. The period of opening of the delivery nozzles 10 of the three cylinders are shown as periods A1, A2 and A3 respectively, whereas the period of opening of the fuel injectors of the three cylinders are shown as periods F1, F2 and F3 respectively in the chart. The TDC positions for each cylinder are shown spaced apart 120° about the chart.

Referring initially to the TDC position of the first cylinder (TDC1) shown at the top of the chart, the delivery injector nozzle 10 of the first cylinder 3 is opened prior to TDC1 over the period A1. The first cylinder 3 is therefore undergoing a compression stroke prior to TDC1. At the same time, the delivery nozzle 10 of the second cylinder 4 is opened over the period A2 with the second cylinder 4 completing an expansion stroke and commencing a compression stroke as it passes through it's BDC position. The fuel injector 9 of the second cylinder also supplies fuel to the delivery injector nozzle 10 of the second cylinder 4 over period F2. All these periods A1, A2, F2 overlap resulting in the delivery of atomised fuel to the second cylinder 4. The chart shows the delivery injector nozzles 10 of the first and second cylinders 3, 4 opening simultaneously for the same period. It is however to be appreciated that the delivery injector nozzles 10 of these or any other pairs of cylinders do not need to open at the same time or provide an overlap of the opening of the delivery injector nozzles thereof.

The TDC position of the second cylinder (TDC2) is shown in the 120° position of the chart. Immediately prior to the TDC2 position as the second cylinder 4 is undergoing a compression stroke, both the delivery injector nozzle of the second and third cylinders 4 and 5 are opened over periods A2 and A3 respectively. As the fuel injector 9 of the third cylinder 5 is supplying fuel to the injector nozzle of the third cylinder 5 over period F3, the air transferred from the second cylinder 4 enables the delivery of fuel to the third cylinder 5.

The TDC position of the third cylinder (TDC3) is shown in the 240° position of the chart. The injector nozzles 10 of the third and first cylinders 5, 3 are both opened over periods A3 and A1 respectively, and the fuel injector 9 of the first cylinder 3 is opened over period F1 to effect delivery of fuel into the first cylinder 3 in the same manner as described above.

Because the fuel is injected into a receiving cylinder before there is any substantial pressure rise therein, this allows for the transfer or displacement of gas between the cylinders to occur, the delivery cylinder typically being at a higher pressure than the receiving cylinder. Therefore, the delivery cylinder is typically undergoing a compression stroke while the receiving cylinder is typically undergoing an expansion stroke. The receiving cylinder typically receives air about or just after the BDC position thereof.

Figure 3:
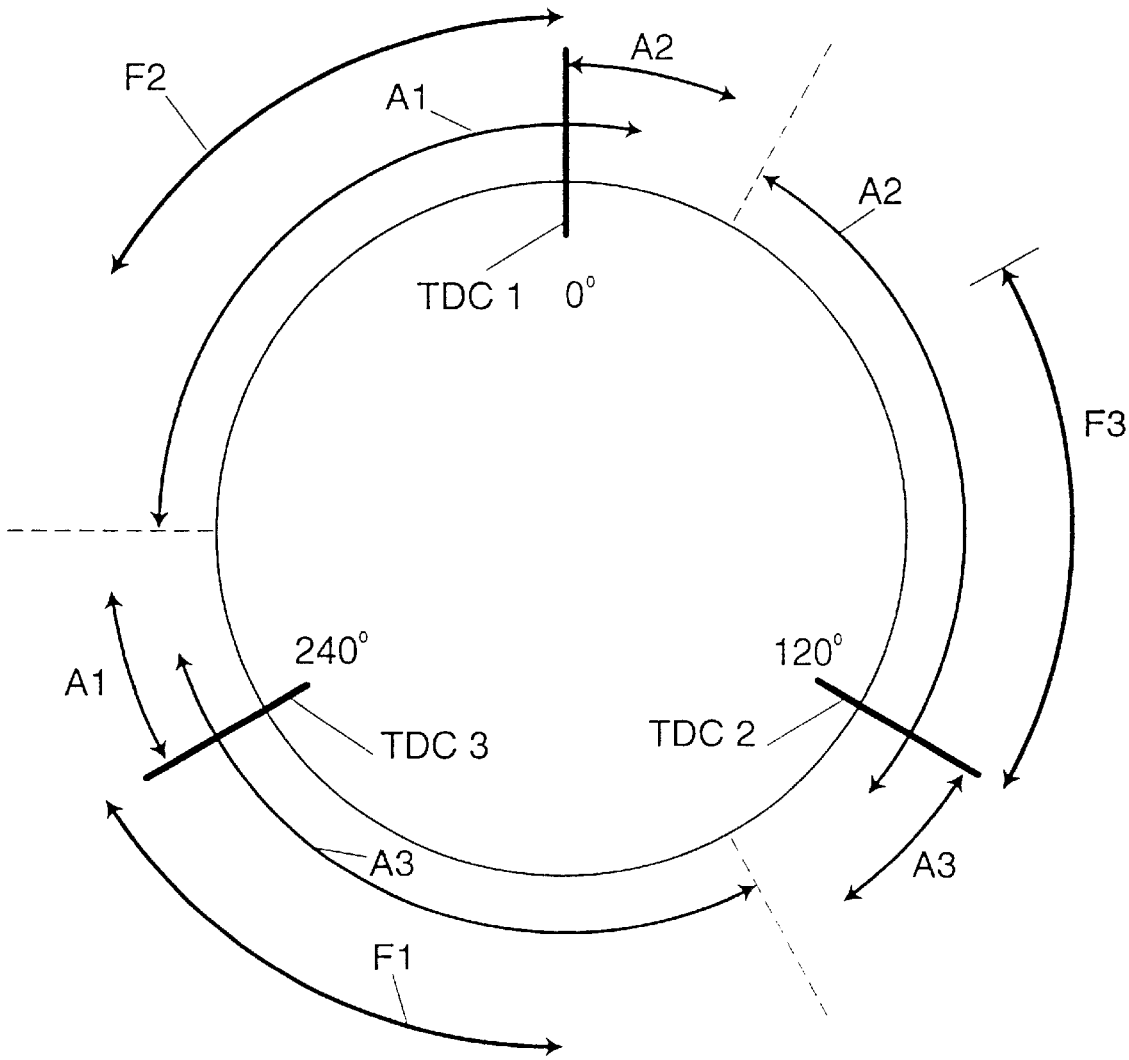
FIG. 3 is an injector timing chart for the same engine as shown in FIG. 2 depicting a different mode of operation according to the method of the present invention.

FIG. 3 shows the injector timing chart for a three cylinder two stroke engine wherein a variation of the method of the present invention is employed. The period of opening of the delivery injector nozzles 10 are again shown as periods F1, F2 and F3. As per FIG. 2, the chart shows the typical injector timings during start-up of the engine with the TDC positions for each cylinder being shown spaced apart 120° about the chart.

Assuming that the engine start-up routine is commenced just after TDC3, it will be seen that the delivery injector nozzle 10 of the first cylinder 3 is opened prior to TDC1 over the period A1. In this instance, the delivery injector nozzle of the first cylinder 3 may also be held open for a short period after TDC1. The pressure within the first cylinder 3 is generally increasing during the period A1 and hence this first opening of the delivery injector nozzle 10 of the first cylinder 3 serves to transfer/capture a maximum possible pressure in the air rail 7. Some time after the commencement of the period A1, the fuel injector 9 of the second cylinder 4 is opened to commence metering a quantity of fuel to the delivery injector nozzle 10 of the second cylinder 4. In this instance, this fuel metering event is completed prior to the opening of the fuel metering nozzle 10 of the second cylinder 4.

As can be seen from the timing chart, the timing of opening of the delivery injector nozzle 10 of the second cylinder 4 is opened whilst the delivery injector nozzle 10 of the first cylinder 3 is still open. This is done to enable the maximum possible pressure to be transferred into the air rail 7, but also such that the delivery of fuel may occur into the second cylinder 4 when the pressure rise therein. In this connection it will be noted that the transfer and exhaust parts of the second cylinder 4 of the two stroke engine will still be opened during part or all of the period A2 and will hence contribute to their being a desirable pressure differential across the delivery injector nozzle 10 of the second cylinder 4.

Hence, the pressure which is captured/transferred into the air rail 7 during the period A1 is used to effect fuel delivery into the second cylinder 4 over the period A2. As alluded to hereinbefore, a portion of the pressure delivered into the air rail 7 during the period A1 may be retained in the air rail 7 subsequent to the period A2. In this way, the pressure within the air rail 7 may be progressively increased to raise it up to a predetermined level whilst fuel is being delivered by way of captured/transferred gas into the cylinders of the engine.

The TDC position of the second cylinder 4 (TDC2) is again shown at the 120° position of the chart. As can be seen, the routine as described above is repeated wherein gas pressure is delivered into the air rail 7 over the period A2 and subsequently used to deliver fuel (which has been delivered to the delivery injector nozzle 10 of the third cylinder 5 over the period F3) into the third cylinder 5 over the period A3. In a similar manner, gas is transferred into the air rail 7 from the second cylinder 4 whilst the pressure therein is increasing (mainly on the compression stroke) and a portion of the gas pressure is then used to effect fuel delivery into the third cylinder 5 at a time when there is a maximum differential pressure existing between the pressure in the third cylinder 5 (wherein the piston 6 has only recently commenced its compression stroke).

The TDC position of the third cylinder 5 (TDC3) is shown in the 240° position of the chart. The injector nozzles 10 of the third and first cylinders 5, 3 are both opened over periods A3 and A1 respectively, and the fuel injector 9 of the first cylinder 3 is opened over the period F1 to affect delivery of fuel into the first cylinder 3 in the same manner as described above.

By way of this variation to the method of the present invention, it is evident that whilst there is some overlaps between the open periods of the injector nozzles 10 of a delivering cylinder and a receiving cylinder, these open periods are different in duration and timing. As can be seen from the chart, the typical open period for the delivery injector nozzle 10 of a cylinder when being used to transfer gas pressure into the air rail 7 is for example between 90° BTDC and 10° ATDC. The typical timing of opening for the delivery injector nozzle 10 of a cylinder when being used to deliver fuel into a receiving cylinder is for example between 120° to 110° BTDC.

It is also envisaged that the method according to the present invention may be combined with the method described in the Applicant's earlier U.S. Pat. No. 4,936,279 or the method discussed in the Applicant's PCT Patent Application No. PCT/AU97/00438 such that by adjusting the timings of the opening of the delivery injector nozzles 10 as shown in PCT Patent Application No. PCT/AU97/00438, a degree of pump-up of the air rail 7 can still occur.

An important point to note in regard to the method of the present invention is that the delivery injector nozzle 10 of a cylinder is typically required to open twice during a single cylinder cycle. A first opening of the delivery injector nozzle 10 during the cylinder cycle is used to perform a fuel delivery event to the cylinder. A second opening of the same delivery injector nozzle 10 is used to perform or gas capture/transfer event such that the gas pressure provided by the cylinder may be used to effect the delivery of fuel by way of gas into a different cylinder. Hence, both functions are performed by the one delivery injector nozzle 10 as is evidenced in FIGS. 2 and 3.

It has been found that the method according to the present invention can reduce the start-up time for the engine to around 0.6 to 0.7 seconds. It should be noted that the minimal delay in engine start-up according to the present invention is still required because the encoder of the engine must typically determine the angular position of the engine before the method according to the present invention may operate. This can take up to ⅓ or 1 ⅓ revolutions of the crankshaft of the engine from the beginning of engine start sequence.

It is possible that, during the start-up of the engine, some fuel may also be transferred between cylinders. This is due to the fact that, in using the method according to the present invention, a receiving cylinder may in turn become a delivery cylinder after it has had fuel delivered thereinto by way of gas from the air rail 7 being transferred through the delivery injector nozzle 10 thereof. Hence, when the delivery injector nozzle 10 of this cylinder is subsequently opened (or maintained open following the initial delivery of fuel thereby) to enable some gas to be transferred into the air rail 7 during the compression stroke of the piston 6 supported therein, some fuel (previously delivered into this cylinder) may also be transferred into the air rail 7. However, it has been found that this does not adversely effect the operation of the engine at start-up.

The present invention is also applicable to other multi-cylinder engine configurations such as V-engines. For example, in a V 6 engine, the two separate banks of cylinders may be made to operate independently during a start-up period wherein the method according to the present invention is used separately in relation to each bank of cylinders. Once the engine has successfully completed start-up, it may then be operated in the normal manner.

The above description is provided for the purposes of exemplification only and it will be understood by a person skilled in the art that modifications and variations may be made without departing from the invention.

What is claimed is:

1. A method of operating an internal combustion engine, the engine having a plurality of cylinders each respectively supporting a piston therein, a fuel injection system including a plurality of selectively operable delivery injector nozzles, and a gas supply system for supplying gas to the delivery injector nozzles, each delivery injector nozzle arranged to respectively deliver fuel by way of said gas directly into a said engine cylinder, the method including opening the delivery injector nozzles of a first said cylinder and a second said cylinder such that gas within the first said cylinder is transferred through the delivery injector nozzle thereof and into the gas supply system resulting in the gas being supplied to the delivery injector nozzle of the second said cylinder to thereby effect the delivery of fuel thereto, wherein each of the first and second said cylinders are operated to effect combustion during a respective cylinder cycle in a same engine cycle, and wherein the delivery injector nozzles of the first and second cylinders are simultaneously open for a period in said same engine cycle when the transfer of gas from the first said cylinder into the gas supply system results in gas and fuel being supplied to the second said cylinder.

2. A method according to claim 1, wherein the timing of opening and the open period of the delivery injector nozzle of the first said cylinder are selected to enable the maximum possible pressure to be transferred into the gas supply system from the first said cylinder.

3. A method according to claim 1, wherein the timing of opening of the delivery injector nozzle of the second said cylinder is selected to provide the maximum possible pressure differential across the delivery injector nozzle.

4. A method according to claim 1, wherein a portion of the gas transferred through the delivery injector nozzle of the first said cylinder is retained in the gas supply system subsequent to the delivery of fuel by way of the gas to the second said cylinder.

5. A method according to claim 1, wherein the opening and closing of the delivery injector nozzle of the first said cylinder is controlled with respect to crank angle.

6. A method according to claim 1, wherein the delivery injector nozzle of the first said cylinder is opened when the gas pressure therein has commenced or is increasing in magnitude.

7. A method according to claim 1, wherein the delivery injector nozzle of first said cylinder is opened while said piston supported therein has initiated or is undergoing a compression stroke.

8. A method according to claim 1, wherein the delivery injector nozzle of the second said cylinder is opened at a point where the gas pressure in the second said cylinder is lower than the gas pressure in the gas supply system.

9. A method according to claim 1, wherein the delivery injector nozzle of the second said cylinder is opened shortly before or once travel of said piston supported therein has reached the bottom dead centre (BDC).

10. A method according to claim 1, wherein the delivery injector nozzle of the second said cylinder is opened when said piston supported therein is about to or has just completed an expansion or power stroke.

11. A method according to claim 1, wherein the delivery injector nozzle of the second said cylinder is controlled as a duration based event that commences at a defined crank angle.

12. A method according to claim 1, wherein the opening of the delivery injector nozzles of the first said cylinder and the second said cylinder are overlapped over a predetermined period.

13. A method according to claim 1, wherein in engines having more than two cylinders, the method is conducted sequentially over respective pairs of cylinders.

14. A method according to claim 1, wherein the period of opening of the two delivery injector nozzles is at least identical.

15. A method according to claim 1, wherein the engine is a four-stroke engine, and wherein the delivery injector nozzle of the second said cylinder is opened when said piston supported therein is either about to complete an intake stroke or has just completed an intake of stroke.

16. A method according to claim 1, including modifying the timing of the opening and closing of the delivery injector nozzle of the first said cylinder to provide a progressive increase of the pressure within the gas supply system.

17. A method according to claim 1, the engine being a three cylinder two-stroke engine, the delivery injector nozzle of the first said cylinder being opened about the TDC point, while the delivery injector nozzle of the second said cylinder is opened about the BDC point.

18. A method according to claim 17, the engine being a three cylinder engine, wherein the delivery injector nozzle of the first said cylinder is opened between 90 degrees before TDC to 10 degrees after TDC, and the delivery injector nozzle of the second said cylinder is opened between 210 degrees before TDC to 110 degrees before TDC.

19. A method according to claim 1, wherein the fuel is wholly or partly delivered to the delivery injector nozzle of the second said cylinder prior to the opening of the delivery injector nozzle thereof.

20. A method according to claim 1, wherein the fuel is delivered to the delivery injector nozzle of the second said cylinder subsequent to the opening of the delivery injector nozzle thereof.

21. A method according to claim 1, wherein the delivery of fuel to the second said cylinder occurs before any significant pressure rise in the second said cylinder.

22. A method according to claim 21, wherein inlet and/or exhaust ports of the second said cylinder are opened at least during the initial portion of the period opening of the delivery injector nozzle thereof.

23. A method according to claim 1, wherein the delivery injector nozzle of a cylinder is opened twice during a single cylinder cycle.

24. A method according to claim 1, wherein the method is used during start-up of the engine.

25. A method according to claim 1, wherein a cylinder which initially delivers gas into the gas supply system to enable the delivery of fuel to another cylinder subsequently receives gas from the gas supply system to enable the delivery of fuel thereinto.

26. A method according to claim 1, wherein the delivery injector nozzle of a cylinder is operated to permit both the transfer of gas to and from the cylinder within a single cylinder cycle.

27. A method according to claim 1, wherein fuel is entrained in said gas prior to passing through the delivery injector nozzle of the second said cylinder.

28. A method according to claim 1, wherein the fuel is delivered to the second said cylinder during an initial rotation of the engine.

29. An internal combustion engine having a plurality of cylinders each respectively supporting a piston therein, a fuel injection system including a plurality of selectively operable delivery injector nozzles, and a gas supply system for supplying gas to the delivery injector nozzles, each delivery injector nozzle arranged to respectively deliver fuel by way of said gas directly into a said engine cylinder, said engine including control means for controlling the engine so as to open the delivery injector nozzles of a first said cylinder and of a second said cylinder such that gas within the first said cylinder is transferred through the delivery injector nozzle thereof and into the gas supply system resulting in the gas being supplied to the delivery injector nozzle of the second said cylinder to thereby effect the delivery of fuel thereto, wherein each of the first and second said cylinders are operated to effect combustion during a respective cylinder cycle in a same engine cycle, and wherein the delivery injector nozzles of the first and second said cylinders are simultaneously open for a period in said same engine cycle when the transfer of gas from the first said cylinder into the gas supply system results in gas and fuel being supplied to the second said cylinder.

30. An engine according to claim 29, wherein the timing of opening and the open period of the delivery injector nozzle of the first said cylinder are selected to enable the maximum possible pressure to be transferred into the gas supply system from the first said cylinder.

31. An engine according to claim 29, wherein the timing of opening of the delivery injector nozzle of the second said cylinder is selected to provide the maximum possible pressure differential across the delivery injector nozzle.

32. An engine according to claim 29, wherein a portion of the gas transferred through the delivery injector nozzle of the first said cylinder is retained in the gas supply system subsequent to the delivery of fuel by way of the gas to the second said cylinder.

33. An engine according to claim 29, wherein the control means controls the delivery injector nozzle of the first said cylinder such that it opens whilst said piston supported therein has initiated or is undergoing a compression stroke.

34. An engine according to claim 29, wherein the control means controls the delivery injector nozzle of the second said cylinder such that the delivery injector nozzle of the second said cylinder opens at a point where the gas pressure in the second said cylinder is lower than the gas pressure in the gas supply system.

35. An engine according to claim 29, wherein the control means opens the delivery injector nozzle of the first said cylinder about the TDC point, while the control means opens the delivery injector nozzle of the second said cylinder about the BDC point.

36. An engine according to claim 29, wherein the control means for controlling the engine controls the engine by overlapping the opening of the delivery injector nozzle of the first said cylinder and the opening of the delivery injector nozzle of the second said cylinder.

37. An engine according to claim 29, wherein the delivery injector nozzle of a cylinder is opened twice during a single cylinder cycle.

38. An engine according to claim 29, wherein the control means controls the engine during a start-up period thereof.

39. An engine according to claim 29, wherein the gas supply system includes a supply of gas, a compressor for supplying compressed gas to the supply of gas and a communication means between the supply of gas and the compressor.

40. An engine according to claim 39, wherein an isolating means is provided between the gas supply volume and the compressor for isolating the compressor.

41. An engine according to claim 40, wherein the isolating means further isolates the communication means from the gas supply volume, at least during the start-up period of the engine.

42. An engine according to claim 40, wherein the isolating means includes a one-way valve means located between the gas supply volume and the compressor.

43. An engine according to claim 42, wherein the communication means between the gas supply volume and the compressor includes a supply conduit and the valve means is located between the supply conduit and the gas supply volume.

44. An engine according to claim 29, wherein the supply of gas from the first said cylinder into the gas supply system and the supply of gas to the second said cylinder from the gas supply system occur during the same cylinder cycle.

45. An engine according to claim 29, wherein a cylinder which initially delivers gas into the gas supply system to enable the delivery of a fuel to another cylinder subsequently receives gas from the gas supply system to enable the delivery of fuel thereinto.

46. An engine according to claim 29, wherein fuel is entrained in said gas prior to passing through the delivery injector nozzle of the second said cylinder.

47. An engine according to claim 29, wherein the fuel is delivered to the second said cylinder during an initial rotation of the engine.

48. A method of operating an internal combustion engine, the engine having a plurality of cylinders each respectively supporting a piston therein, a fuel injection system including a plurality of selectively operable delivery injector nozzles, and a gas supply system for supplying gas to the delivery injector nozzles, each delivery injector nozzle arranged to respectively deliver fuel by way of said gas directly into a said engine cylinder, the method including opening the delivery injector nozzles of a first said cylinder and a second said cylinder such that gas within the first said cylinder is transferred through the delivery injector nozzle thereof and into the gas supply system resulting in the gas being supplied to the delivery injector nozzle of the second said cylinder to thereby effect the delivery of fuel thereto, wherein each of the first and second said cylinders are operated to effect combustion during a respective cylinder cycle in a same engine cycle, and wherein the open delivery injector nozzles of the first said cylinder and the second said cylinder overlap over a predetermined period in said same engine cycle and said gas is supplied to the delivery iniector nozzle of the second said cylinder to deliver fuel while the delivery injector nozzles of said first and second cylinders are simultaneously open.

49. A method according to claim 48, wherein the fuel is delivered to the second said cylinder during an initial rotation of the engine.

50. An internal combustion engine having a plurality of cylinders each respectively supporting a piston therein, a fuel injection system including a plurality of selectively operable delivery injector nozzles, and a gas supply system for supplying gas to the delivery injector nozzles, each delivery injector nozzle arranged to respectively deliver fuel by way of said gas directly into a said engine cylinder, said engine including control means for controlling the engine so as to open the delivery injector nozzles of a first said cylinder and of a second said cylinder such that gas within the first said cylinder is transferred through the delivery injector nozzle thereof and into the gas supply system resulting in the gas being supplied to the delivery injector nozzle of the second said cylinder to thereby effect the delivery of fuel thereto, wherein each of the first and second said cylinders are operated by said control means to effect combustion during a respective cylinder cycle in a same engine cycle, and wherein the control means for controlling the engine does so by overlapping the opening of the delivery injector nozzle of the first said cylinder and the opening of the delivery injector nozzle of the second said cylinder in said same engine cycle and said gas is supplied to the delivery iniector nozzle of the second said cylinder to deliver fuel while the delivery iniector nozzles of said first and second cylinders are simultaneously open.

51. An engine according to claim 50, wherein the fuel is delivered to the second said cylinder during an initial rotation of the engine.

* * * * *